US008910695B2

(12) United States Patent
Knight

(10) Patent No.: US 8,910,695 B2
(45) Date of Patent: Dec. 16, 2014

(54) SYSTEMS AND METHODS FOR REMOTE CONTROL OF A MOVABLE PARTITION

(75) Inventor: Tracy M. Knight, Kearns, UT (US)

(73) Assignee: Won-Door Corporation, Salt Lake City, UT (US)

( * ) Notice: Subject to any disclaimer, the term of this patent is extended or adjusted under 35 U.S.C. 154(b) by 262 days.

(21) Appl. No.: 13/408,778

(22) Filed: Feb. 29, 2012

(65) Prior Publication Data

US 2013/0220558 A1 Aug. 29, 2013

(51) Int. Cl.
*E06B 3/48* (2006.01)

(52) U.S. Cl.
USPC ..... 160/84.02; 160/188

(58) Field of Classification Search
CPC ..... E05D 15/00; E05D 15/28; E05F 15/2046; E05F 15/142; E05Y 2900/142
USPC ..... 160/84.02, 168.1 P, 188, 310; 318/16, 318/280, 283, 466
See application file for complete search history.

(56) References Cited

U.S. PATENT DOCUMENTS

| | | | | |
|---|---|---|---|---|
| 3,807,480 | A * | 4/1974 | Smart | 160/1 |
| 4,958,112 | A * | 9/1990 | Zerillo | 318/280 |
| 4,991,350 | A * | 2/1991 | Kirk | 49/169 |
| 5,982,125 | A * | 11/1999 | Ranaudo et al. | 318/466 |
| 6,347,486 | B1 * | 2/2002 | Badillet | 49/394 |
| 6,662,848 | B2 * | 12/2003 | Goodman et al. | 160/84.02 |
| 7,466,090 | B2 * | 12/2008 | Meewis et al. | 318/280 |
| 2004/0094275 | A1 * | 5/2004 | Goodman et al. | 160/188 |
| 2006/0144529 | A1 * | 7/2006 | Hemphill | 160/188 |
| 2011/0000625 | A1 | 1/2011 | George | |
| 2011/0259532 | A1 * | 10/2011 | Smart et al. | 160/188 |
| 2013/0227885 | A1 * | 9/2013 | Dawber | 49/25 |

OTHER PUBLICATIONS

Smart et al., U.S. Appl. No. 13/169,299, filed Jun. 27, 2011, titled Methods, Apparatuses, and Systems for Driving a Movable Partition with a Lead Drive Box.

* cited by examiner

*Primary Examiner* — Katherine Mitchell
*Assistant Examiner* — Abe Massad
(74) *Attorney, Agent, or Firm* — TraskBritt

(57) ABSTRACT

A remote control system for use with a movable partition comprises a motor configured to drive movement of a movable partition of a movable partition system, a processor coupled with the motor to generate an actuation signal to control the motor, and a remote control switch coupled with the motor and configured to transmit a trigger signal to the processor in response to receiving an activation signal from a remote control key. The processor is configured to control the motor to drive the movable partition to a predetermined position along a track in response to the trigger signal. A method of driving a movable partition comprises receiving an activation signal from a remote control key, and driving the movable partition to an intermediate position along a track to provide access to user interface elements of the movable partition in response to receiving the activation signal.

17 Claims, 12 Drawing Sheets

SYSTEMS AND METHODS FOR REMOTE CONTROL OF A MOVABLE PARTITION

FIELD

Embodiments of the present disclosure relate generally to the control of movable partitions and, more particularly, to the remote control of a movable partition for access to user interface elements of such movable partitions.

BACKGROUND

Movable partitions are used in numerous environments for a variety of purposes. Such movable partitions may be used to temporarily divide a single large room into two or more smaller rooms. Such movable partitions may also be used for noise control depending, for example, on the activities taking place in a given room or portion thereof. Movable partitions may also be used to provide a security barrier, a fire barrier, or both a security barrier and a fire barrier. In such situations, the movable partition may be configured to automatically close upon the occurrence of a predetermined event, such as the actuation of an associated alarm.

A movable partition may include one or more collapsible doors (e.g., accordion or similar folding-type partitions). For example, each movable partition may include a plurality of panels coupled to one another, such as via hinges or other configurations that permit the plurality of panels to fold during retraction of the movable partition, and for purposes of storage of the movable partition. As a result, the movable partition may be stored in a pocket formed in the wall of a building when the panels are in a retracted (e.g., folded) state.

The movable partition may be deployed by extending the movable partition along an overhead track that may be located above the movable partition in a header assembly. A leading end of the movable partition may complementarily engage another structure, such as a wall, a post, or another door. The leading end of the movable partition may include a structure referred to as a "lead post."

In some situations, the movable partition may be extended and retracted automatically or manually. Automatic extension and retraction of the movable partition may be accomplished through the use of a motor. In some configurations, the motor may be located in a pocket formed in the wall of a building in which the movable partition is stored while in a retracted state. The motor may remain fixed in place within the pocket, and may be used to drive extension and retraction of the movable partition along the overhead track. In other configurations, the motor may be located within the movable partition itself, such that the motor travels with the movable partition as the movable partition is extended and retracted along the overhead track.

Figure 5A:
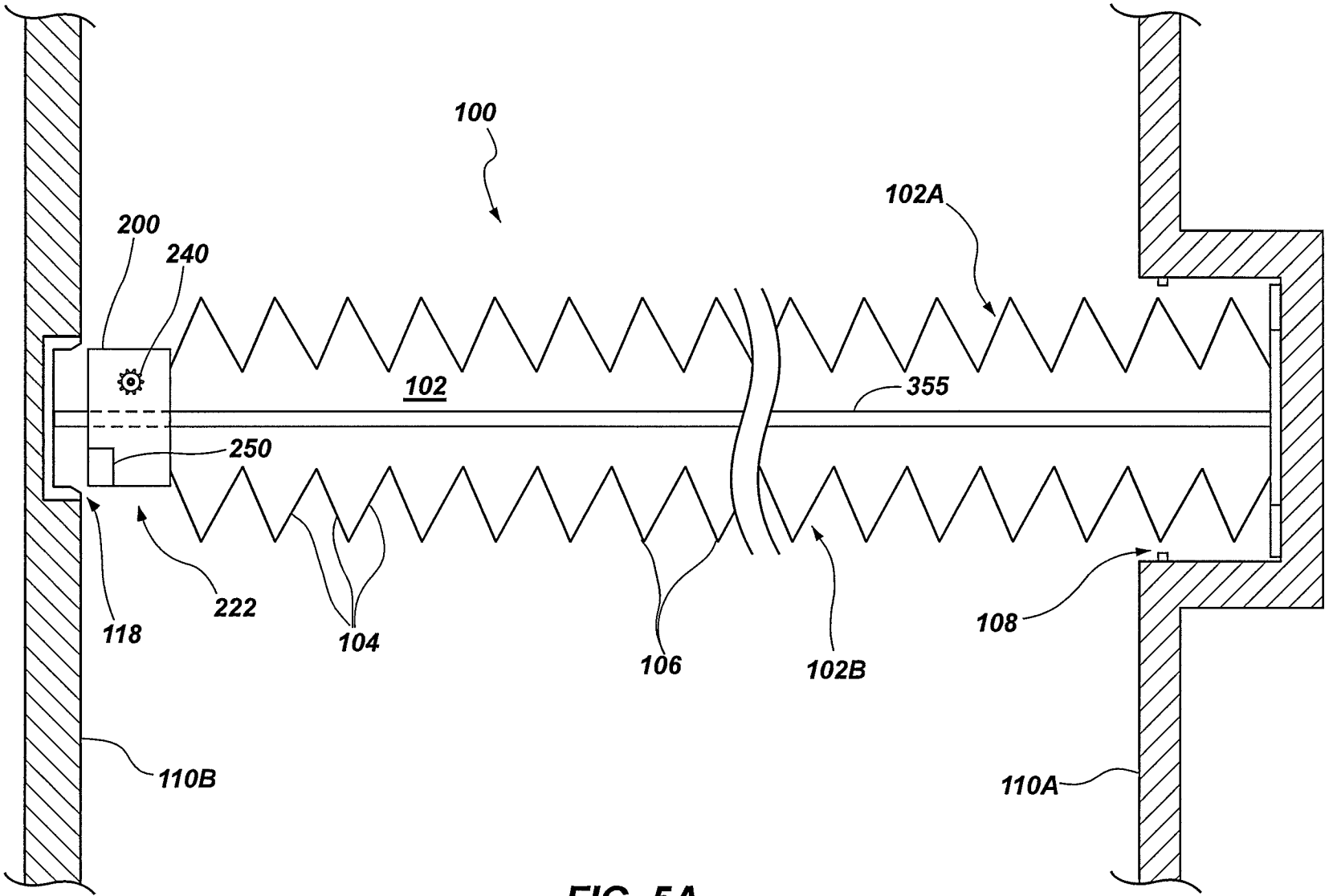
Figure 5B:
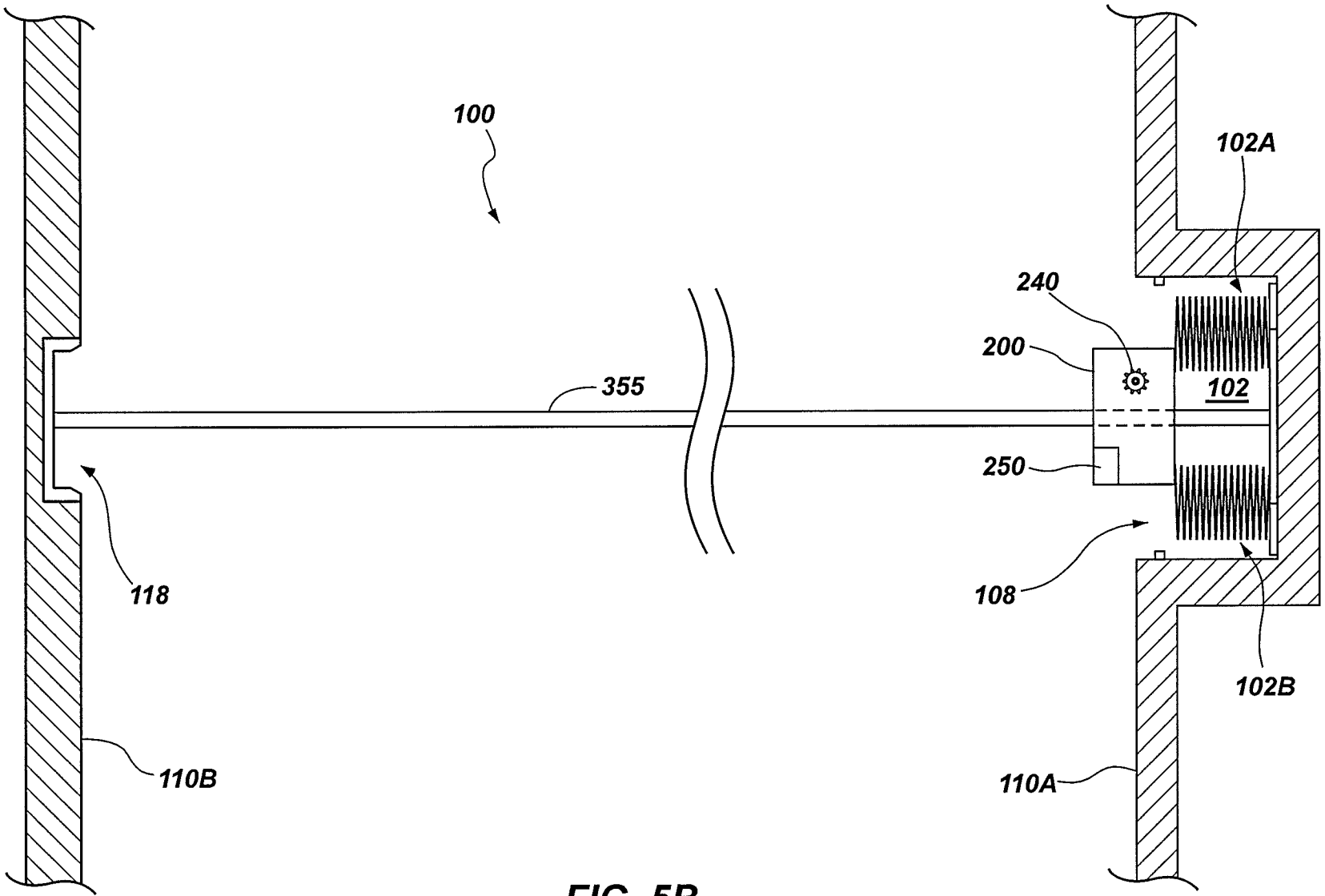

Examples of the movable partition being moved to a desired predetermined position along the track are shown in FIGS. 5A and 5B.

Figure 2A:
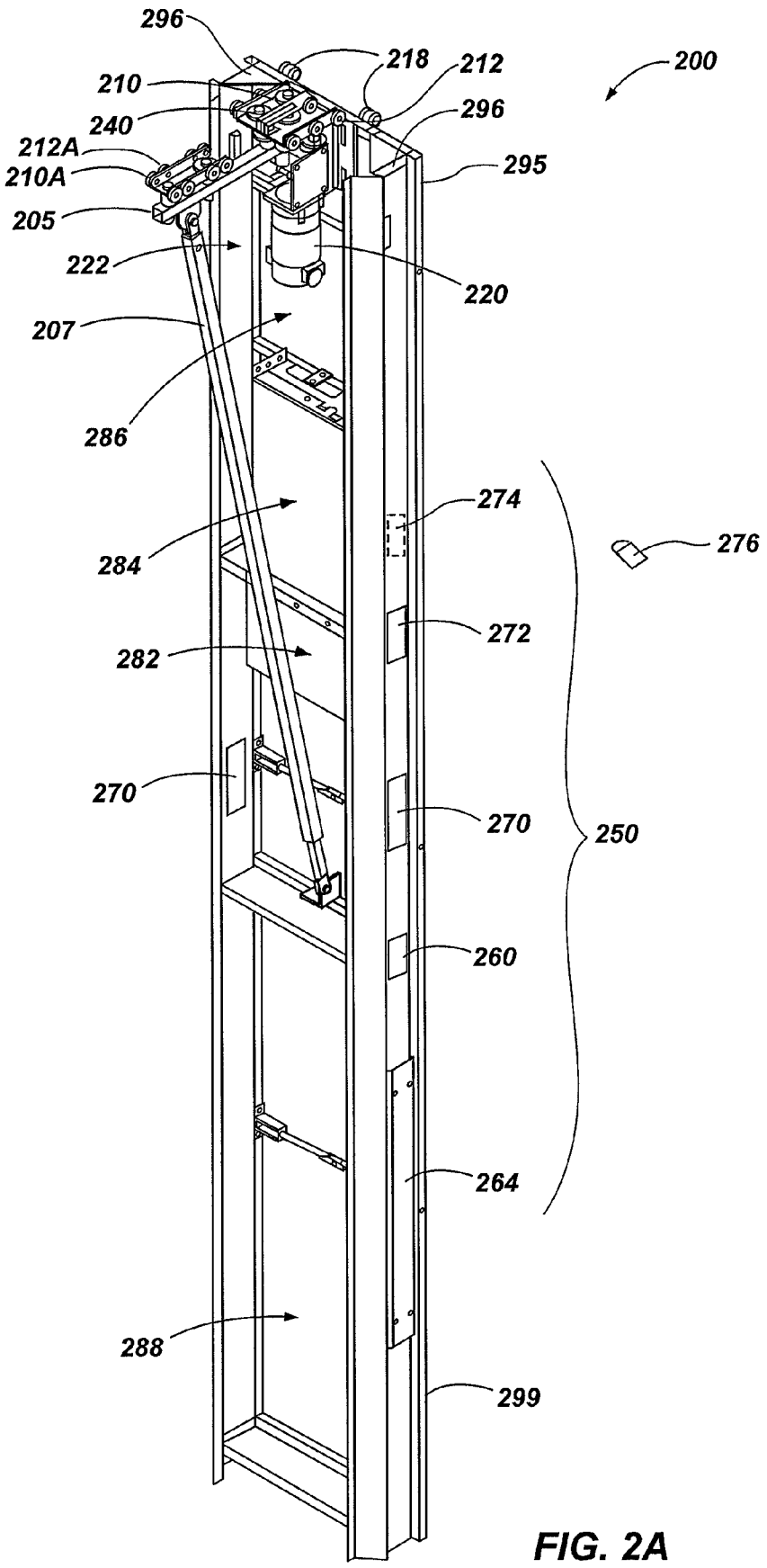
FIG. 2A is a perspective view of a lead drive box for coupling to a leading end of the movable partition of FIG. 1.
Figure 2B:
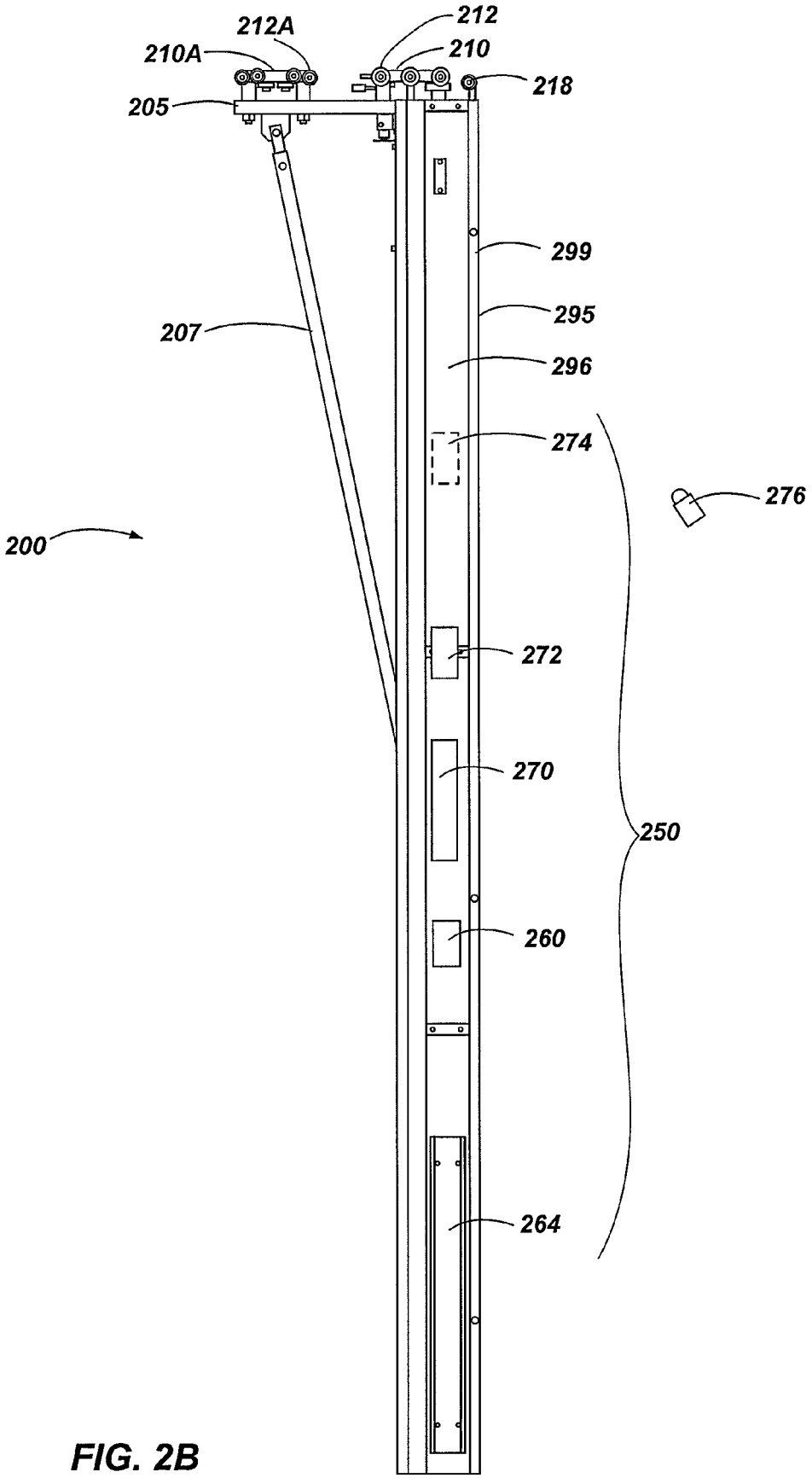
FIG. 2B is a side view of a portion of the lead drive box of FIG. 2A.
Figure 2C:
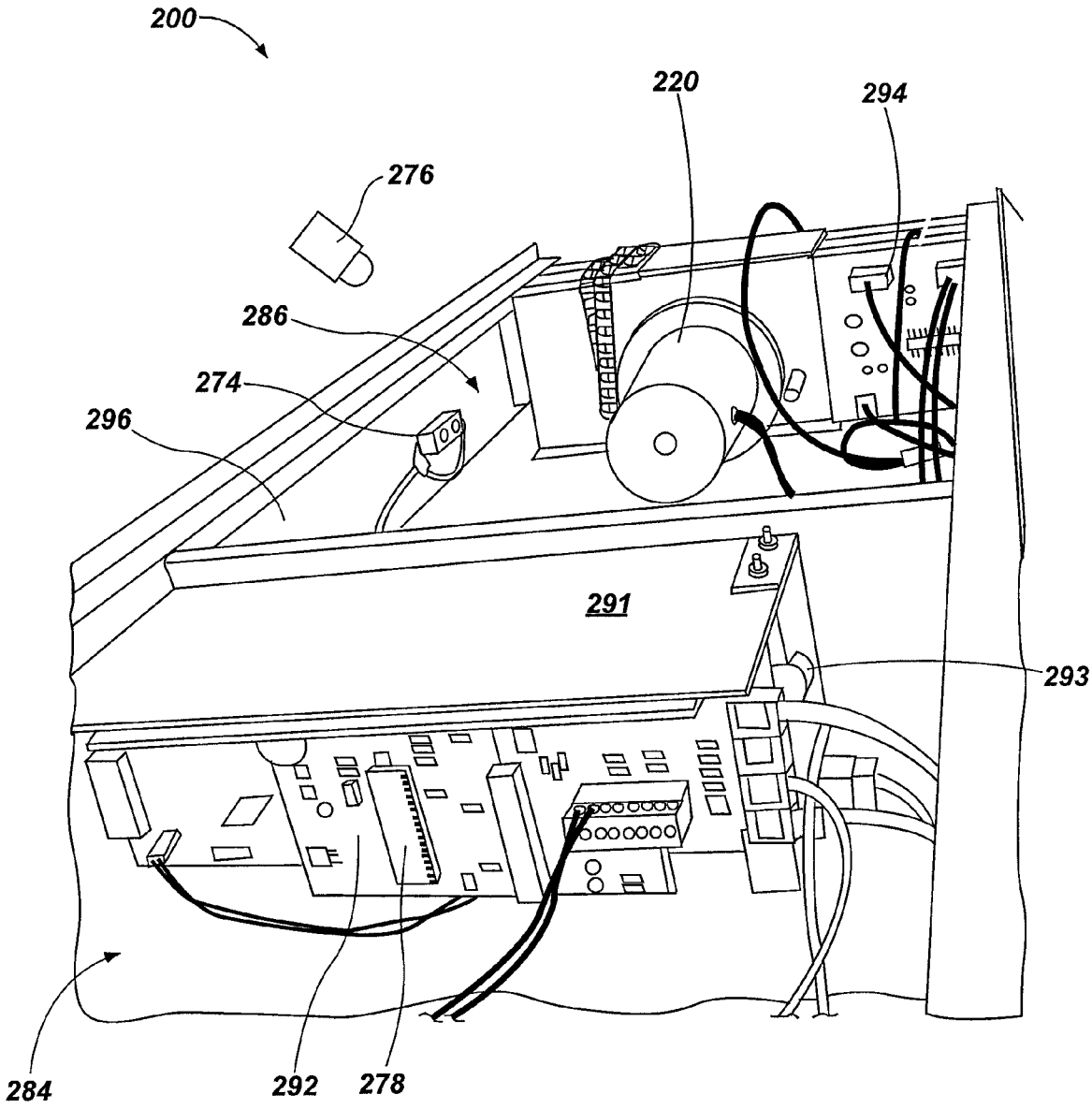
FIG. 2C is a perspective view of the lead drive box of FIGS. 2A and 2B including electronic component modules.
Figure 6:
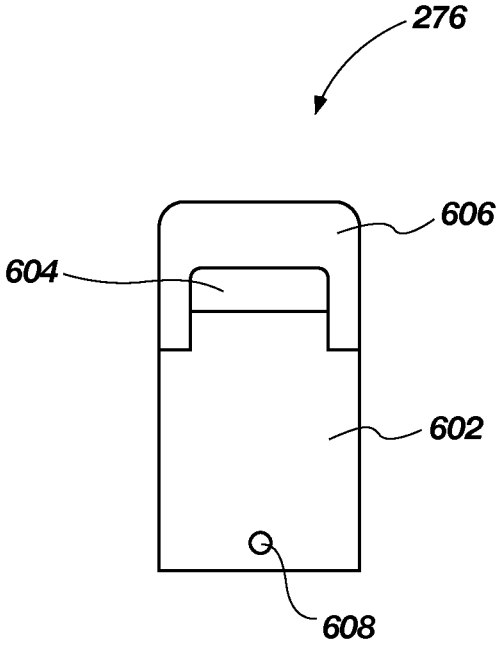

FIG. 6 shows the remote control key of FIGS. 2A, 2B, and 2C, according to an embodiment of the present disclosure.

Figure 7:
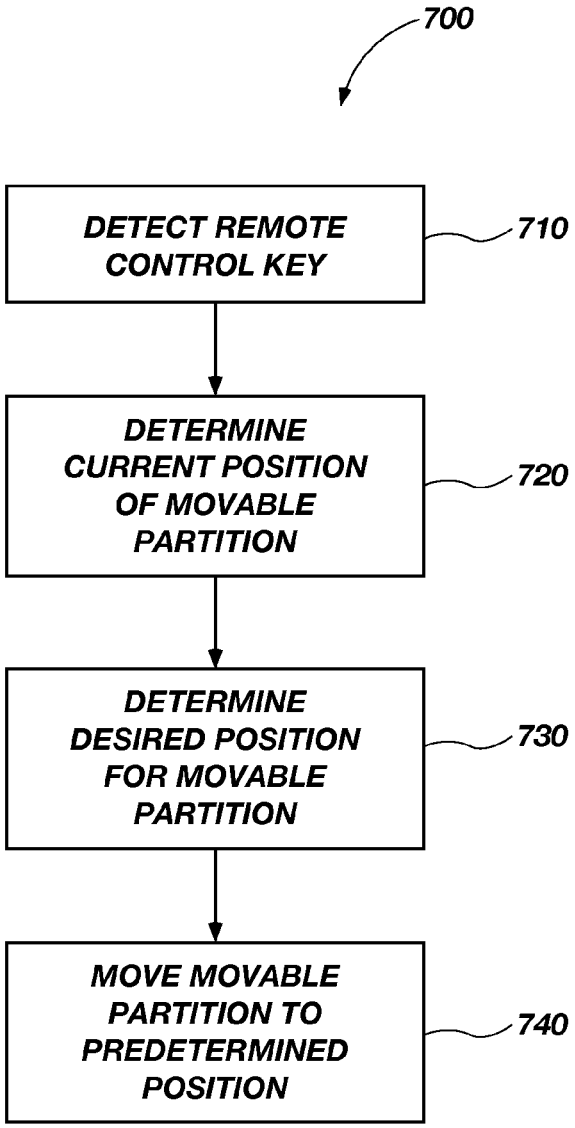

FIG. 7 is a flowchart for a method of remotely controlling movement of a movable partition according to an embodiment of the present disclosure.

Figure 8:
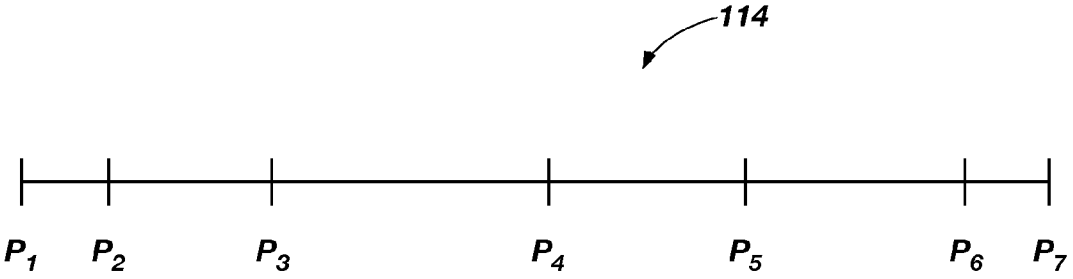

FIG. 8 is a representation of the various positions of the track of the movable partition system.

Figure 9:
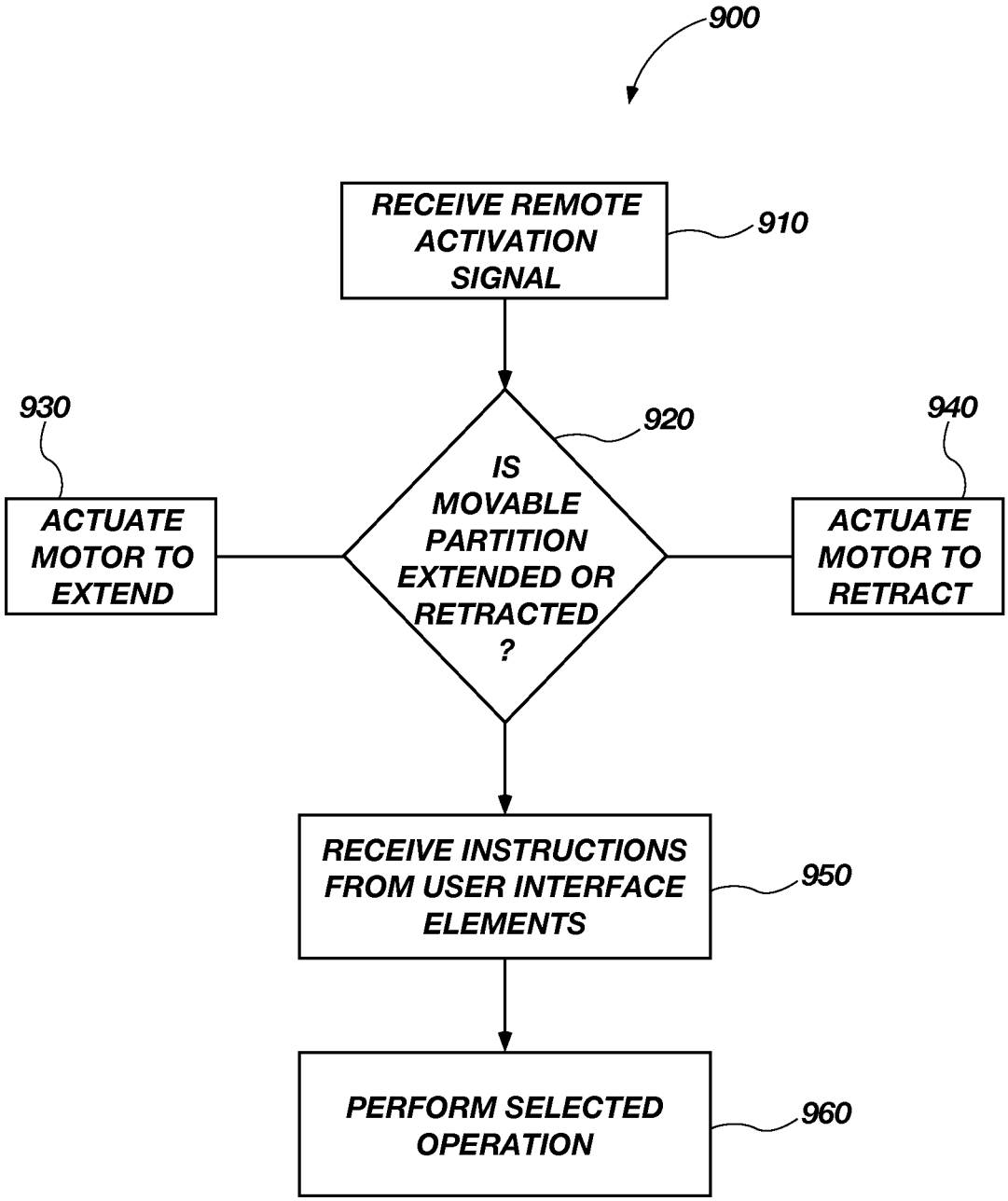

FIG. 9 is a flowchart for a method of remotely controlling movement of a movable partition according to an embodiment of the present disclosure.

DETAILED DESCRIPTION

In the following detailed description, reference is made to the accompanying drawings which form a part hereof, and in which is shown by way of illustration examples of embodiments of the present disclosure. The description and the specific examples, while indicating examples of embodiments of the present disclosure, are given by way of illustration only and not by way of limitation. Other embodiments may be utilized and changes may be made without departing from the scope of the disclosure. Various substitutions, modifications, additions, rearrangements, or combinations thereof may be made and will become apparent to those of ordinary skill in the art. In addition, features from one embodiment may be combined with features of another embodiment while still being encompassed within the scope of the disclosure as contemplated by the inventor. The following detailed description is not to be taken in a limiting sense, and the scope of the present disclosure is defined only by the appended claims and their legal equivalents.

Illustrations presented herein are not meant to be actual views of any particular movable partition system, or component of a movable partition system, but are merely idealized representations, which are employed to describe embodiments of the present disclosure. Specific implementations shown and described are exemplary only and should not be construed as the only way to implement the embodiments of the present disclosure unless specified otherwise herein. Additionally, elements common between figures may retain the same or similar numerical designation.

In the following description, elements, circuits, and functions may be shown in block diagram form for purposes of illustration. Block definitions and partitioning of logic between various blocks is exemplary of a specific implementation. It will be readily apparent to one of ordinary skill in the art that the present disclosure may be practiced by numerous other partitioning solutions. For the most part, details concerning timing considerations and the like have been omitted where such details are not necessary to obtain a complete understanding of the present disclosure and are within the abilities of persons of ordinary skill in the relevant art.

As used herein, the term "processor" may be a general-purpose processor, a special-purpose processor, a Digital Signal Processor (DSP), an Application-Specific Integrated Circuit (ASIC), a Field-Programmable Gate Array (FPGA) or other programmable logic device, discrete gate or transistor logic, discrete hardware components, or any combination thereof designed to perform the functions described herein. A general-purpose processor may be a microprocessor, but in the alternative, the general-purpose processor may be any conventional processor, controller, microcontroller, or state machine. A general-purpose processor may be considered a special-purpose processor when the general-purpose processor is configured to execute instructions (e.g., software code) stored on a computer-readable medium. A processor may also be implemented as a combination of computing devices, such as a combination of a DSP and a microprocessor, a plurality of microprocessors, one or more microprocessors in conjunction with a DSP core, or any other such configuration.

Those of skill in the art understand that information and signals may be represented using any of a variety of different technologies and techniques. For example, data, instructions, commands, information, signals, bits, symbols, and chips that may be referenced throughout the following description may be represented by voltages, currents, electromagnetic waves, magnetic fields or particles, optical fields or particles, or any combination thereof. Some drawings may illustrate signals as a single signal for clarity of presentation and description. It will be understood by a person of ordinary skill in the art that the signal may represent a bus of signals, wherein the bus may have a variety of bit widths, and embodiments of the present disclosure may be implemented with any number of data signals, including a single data signal.

Those of skill would further appreciate that the various illustrative logical blocks, modules, circuits, and algorithm acts described in connection with embodiments disclosed herein may be implemented as electronic hardware, computer software, or combinations of both. To clearly illustrate this interchangeability of hardware and software, various illustrative components, blocks, modules, circuits, and steps are described generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the embodiments of the disclosure described herein.

Also, it is noted that the embodiments may be described in terms of a process that is depicted as a flowchart, a flow diagram, a structure diagram, or a block diagram. Although a flowchart may describe operational acts as a sequential process, many of these operational acts can be performed in another sequence, in parallel, or substantially concurrently. In addition, the order of the operational acts may be rearranged. A process may correspond to a method, a function, a procedure, a subroutine, a subprogram, etc. Furthermore, the methods disclosed herein may be implemented in hardware, software, or a combination thereof. If implemented in software, the functions may be stored or transmitted as one or more instructions or code on a computer-readable medium. Computer-readable media include both computer storage media and communication media including any medium that facilitates transfer of a computer program from one place to another.

It should be understood that any reference to an element herein using a designation such as "first," "second," and so forth does not limit the quantity or order of those elements, unless such limitation is explicitly stated. Rather, these designations may be used herein as a convenient method of distinguishing between two or more elements or instances of an element. Thus, a reference to first and second elements does not mean that only two elements may be employed there or that the first element must precede the second element in some manner. Also, unless stated otherwise, a set of elements may comprise one or more elements.

Figure 1:
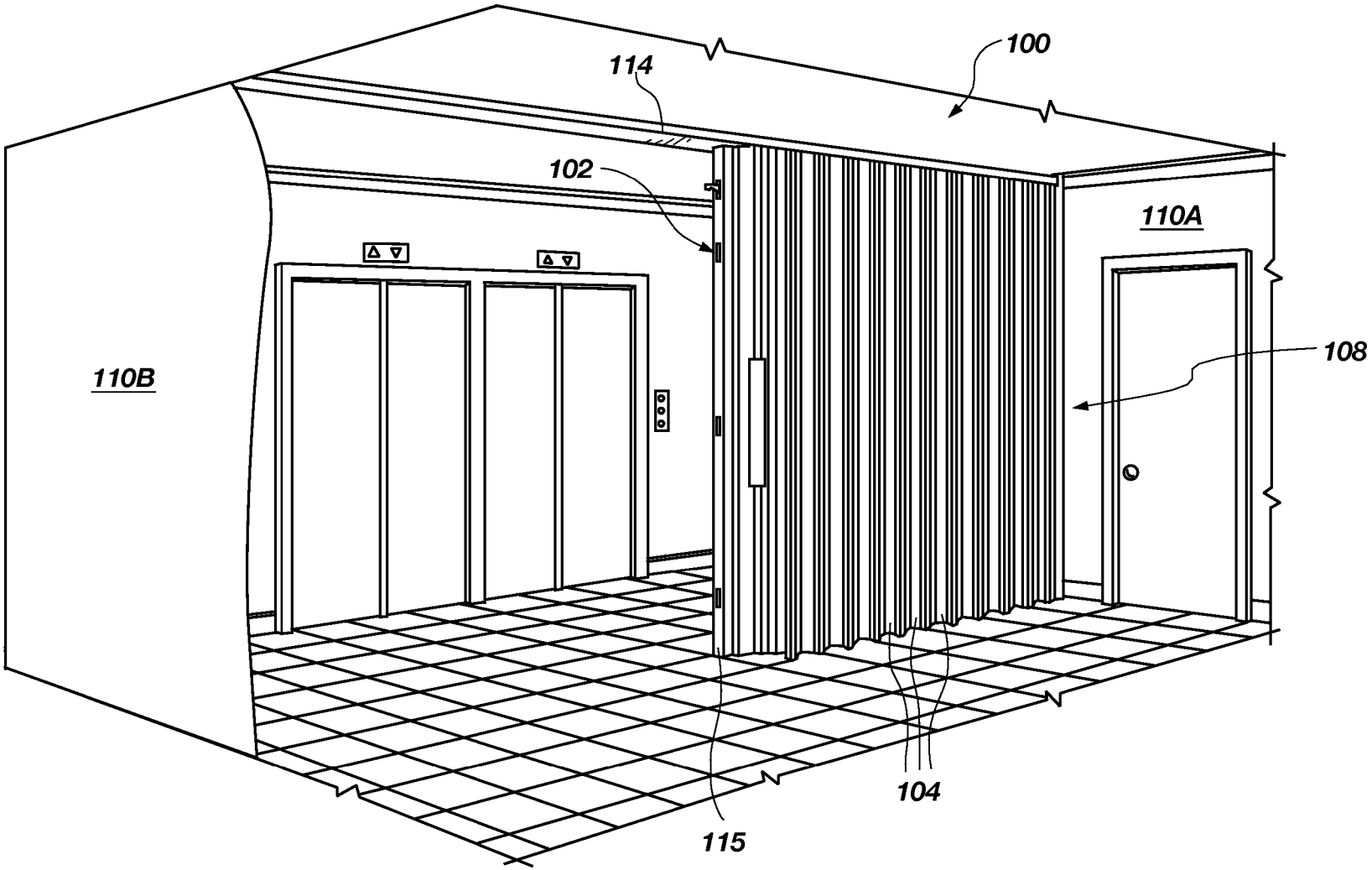
FIG. 1 is a movable partition system according to an embodiment of the present disclosure.

FIG. 1 is a movable partition system 100 according to an embodiment of the present disclosure. The movable partition system 100 may be installed and may be configured for operation as described below. The movable partition system 100 comprises a movable partition 102 that may be used for partitioning space, as a sound barrier, as a fire barrier, as a security barrier, for combinations of such purposes, or for other purposes. The movable partition 102 may be engaged with a track 114, along which the movable partition 102 may be extended and retracted. The track 114 may be an overhead track that is mounted to a ceiling or a door header of a building. Thus, movable partition 102 may be engaged with the track 114 by being suspended from (i.e., hung from) the track 114.

Figure 3A:
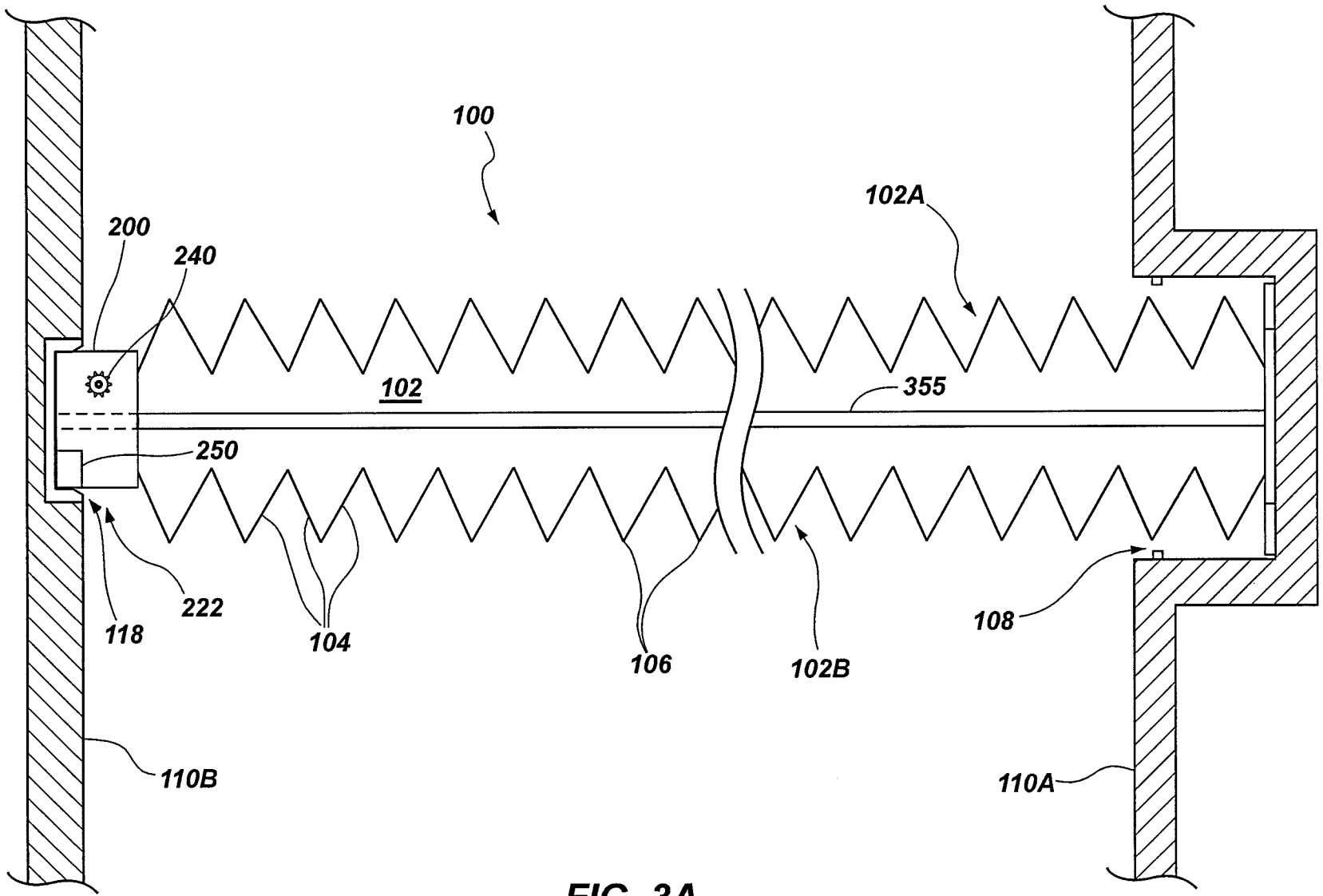
FIGS. 3A and 3B are simplified top views of the movable partition system of FIG. 1 including the lead drive box of FIG. 2A.

The movable partition 102 comprises a plurality of panels 104 that may be arranged in sheets 102A and 102B (FIG. 3A). Therefore, the plurality of panels 104 may also be referred to herein as a sheet of panels 104. The movable partition 102 may include one or more sheets of panels 104, such as two sheets 102A and 102B of panels 104 that are arranged side by side and move together along the track 114. The plurality of panels 104 in each sheet 102A, 102B are coupled with one another in such a manner so as to permit the plurality of panels 104 to fold back and forth relative to one another in an accordion fashion such that the movable partition 102 may collapse (e.g., fold) as the movable partition 102 is retracted. For example, the plurality of panels 104 may be coupled with a hinge member 106 (FIG. 3A) therebetween. In other embodiments, the plurality of panels 104 may be directly coupled with each other without the use of separate hinge members therebetween.

In operation, the movable partition 102 may be deployed to an extended position by driving the movable partition 102 along the track 114 across the space to provide an appropriate barrier. The movable partition 102 may be extended and retracted between a first wall 110A and a second wall 110B of a building. Collapsing the plurality of panels 104 of the movable partition 102 may further permit the movable partition 102 to be compactly stored in a pocket 108 formed in the first wall 110A of a building if the movable partition 102 is in a retracted (i.e., opened) state.

The movable partition system 100 may be an automatic movable partition system, in that the movable partition 102 may be automatically extended and automatically retracted. In some embodiments, the movable partition 102 may be operated either automatically or manually. The movable partition system 100 may comprise a control system and a motor (not shown), for example, to drive movement of the movable partition 102 between the extended and retracted states. The control system and motor may be located proximate to the movable partition 102, in a portion of the movable partition 102, or in a location separate from the movable partition 102.

The leading end of the movable partition 102 may further include a lead post 115 that is coupled with an end of the one or more sheets 102A and 102B (FIG. 3A) of panels 104. The sheets 102A and 102B of panels 104 may be coupled with the lead post 115 in any suitable manner including, but not limited to, using adhesives, tongue and groove joints, and fasteners (e.g., screws, bolts, rivets, etc.). The lead post 115 may be configured to complementarily engage with a striker (e.g., door jamb, door post, etc.) that may be provided in the second wall 110B of a building when the movable partition 102 is in an extended (i.e., closed) state. While the embodiment of the movable partition system 100 of FIG. 1 includes a single movable partition 102, the movable partition system 100 may comprise more than one movable partition 102 in further embodiments of the disclosure. For example, another movable partition (not shown) may extend from the second wall 110B of the building toward the first wall 110A such that the another movable partition may meet and complimentarily engage with the movable partition 102 at a position along an intermediate portion of the track 114.

Embodiments of the present disclosure are shown herein to include a movable partition 102 having a leading end that includes a lead drive box. An example of a lead drive box is described in, for example, U.S. patent application Ser. No. 13/169,299, which was filed Jun. 27, 2011, now U.S. Pat. No. 8,763,672, issued Jul. 1, 2014, and is entitled "Methods, Apparatuses, and Systems for Driving a Movable Partition with a Lead Drive Box," the disclosure of which is incorporated herein in its entirety by this reference. In some embodiments, the leading end of the movable partition 102 may be configured similar to the leading end assemblies described in, for example, U.S. patent application Ser. No. 12/497,310, which was filed Jul. 2, 2009 and is entitled "Movable Partitions, Leading End Assemblies for Movable Partitions and Related Methods," the disclosure of which is incorporated herein in its entirety by this reference. Other leading end assemblies are also contemplated.

Embodiments of the present disclosure include apparatuses and methods for remote control of the movable partition 102. Remote control of the movable partition 102 may include controlling the movement of the movable partition 102 to a predetermined location along the track 114. Thus, the movable partition system 100 may include a remote control system 400 (FIG. 4) associated therewith. At least some components of the remote control system 400 may be included within the leading end of the movable partition 102. Each of the above-referenced configurations of the leading end are to be considered as examples of embodiments that may include components of the remote control system 400. Other configurations of the leading end are contemplated that include the remote control system 400. Of course, one or more elements of the remote control system 400 may be located at other locations of the movable partition system 100. The remote control system 400 will be described more fully below.

As used herein, the term "remote control" is not meant to necessarily imply a specific distance or proximity of an operator to the movable partition 102 or movable partition system 100. Rather, remote control refers to apparatuses and methods that permit an operator to control the movement of the movable partition 102 wirelessly to transmit a remote activation signal 405 (FIG. 4) to initiate movement of the movable partition 102 to a predetermined position along the track 114. Thus, for most embodiments, remote control of the movable partition 102 may be performed without the need to directly contact the movable partition 102, though the operator may nevertheless be proximate the movable partition 102 at the time of generation and detection of the remote activation signal 405.

FIG. 2A is a perspective view of a lead drive box 200 for coupling to the leading end of the movable partition 102 of FIG. 1. FIG. 2B is a side view of a portion of the lead drive box 200 of FIG. 2A. FIG. 2C is a perspective view of the lead drive box 200 of FIGS. 2A and 2B including electronic component modules 292, 293, 294.

The lead drive box 200 may include an automatic drive mechanism 222 (FIG. 2A). The automatic drive mechanism 222 includes a motor 220 coupled with a rotatable drive member 240, such that the motor 220 may be used to drive rotation of the rotatable drive member 240. For example, the rotatable drive member 240 may be coupled with a drive shaft of the motor 220. The drive shaft of the motor 220 may include one or more drive shafts (not visible), such as a first drive shaft that transfers rotation of the motor 220 to a second drive shaft through a clutch.

The lead drive box 200 may further include a trolley 210 coupled with a support bar 205 and configured for coupling with the drive channel of the track 114. The automatic drive mechanism 222 may hang from the trolley 210 and move along the track 114 by the rolling of trolley wheels 212 attached to the trolley 210. The trolley 210 and trolley wheels 212 may be disposed fully or partially within the drive channel of the track 114. The rotatable drive member 240 may also be disposed within the drive channel of the track 114. An elongated, fixed drive member 355 (FIGS. 3A and 3B) may be disposed within the track 114 so as to be engaged with the rotatable drive member 240 when the automatic drive mechanism 222 is in an engaged state. In this configuration, when the motor 220 drives the rotatable drive member 240 and the rotatable drive member 240 is engaged with the fixed drive member 355, the movable partition 102 is extended or retracted (i.e., closed or opened) along the track 114 upon actuation of the motor 220. The motor 220 may further drive the movable partition 102 to a desired position within the track 114.

A diagonal bar 207 may be attached to the support bar 205 and the lead drive box 200. The lead drive box 200, the support bar 205, and the diagonal bar 207 may form a triangle to structurally support the automatic drive mechanism 222, the lead drive box 200, and components encased therein. In some embodiments, an additional trolley 210A with additional trolley wheels 212A may be included near where the support bar 205 and the diagonal bar 207 meet in order to provide additional support and guidance for the lead drive box 200 as the movable partition 102 moves along the track 114.

A gearbox (not shown) may be installed between the motor 220 and the rotatable drive member 240. The gearbox may be desirable for better control or increased power when driving the rotatable drive member 240. The motor 220 may drive a drive shaft (not shown), which is also the input shaft for the gearbox. The gearbox may transfer the power from the motor 220 to the drive shaft. The drive shaft may be coupled with the rotatable drive member 240 to drive the rotation of the rotatable drive member 240. When the rotatable drive member 240 is engaged with the fixed drive member 355 (FIGS. 3A and 3B), the rotation of the rotatable drive member 240 causes the movable partition 102 to move along the track 114 of the movable partition system 100. In some embodiments, the automatic drive mechanism 222 may not include a gearbox. In such embodiments, the motor 220 may drive the drive shaft directly, which is attached to the rotatable drive member 240.

A casing 299 may be attached to the trolley 210, support bar 205, diagonal bar 207, or combinations thereof to form at least a partial enclosure. The casing 299 may include a front side 295. The front side 295 may engage with the second wall 110B (FIG. 1), and in some embodiments, the front side 295 may be substantially planar. The casing 299 may include opposing sides 296 that extend substantially perpendicular from the front side 295 and run substantially parallel with a direction of travel defined by movement of the trolley 210 in the track 114. The lead drive box 200 may further include roller assemblies 218, which may be attached to one or more of the trolley 210, the support bar 205, the diagonal bar 207, and the casing 299, and which may be configured for engaging with the drive channel.

The movable partition system 100 (FIG. 1) may further include various sensors and switches to assist in the control of the movable partition 102 through appropriate coupling with the motor 220. For example, various user interface elements 250 may be coupled with and carried by lead drive box 200. The user interface elements 250 may include user-controlled switches 260, an emergency actuator 264, vision panels 270, a door display 272, and a remote control switch 274, each of which may be positioned on one or more of the opposing sides 296 of the casing 299.

As non-limiting examples, the user-controlled switches 260 and the emergency actuator 264 may generate movement signals such as an open-or-close command, a stop-or-go command, or an emergency command. Such movement signals may be transmitted from the emergency actuator 264 and the user-controlled switches 260 directly to the motor 220, or indirectly to the motor 220 through electrical component modules.

The emergency actuator 264 is commonly referred to as "panic hardware." Operation of the emergency actuator 264 allows a person to cause the door to retract, open, or open partially if it is closed, or to stop while it is closing, allowing access through the barrier formed by the movable partition 102 (FIG. 1) for a predetermined amount of time. Moreover, the movable partition system 100 (FIG. 1) may further include, or may be associated with, an alarm system, which, upon providing an appropriate signal, results in deployment or retraction of the movable partition 102 depending on the specific situation.

The user-controlled switches 260 may be configured to include, for example, a general operation switch. The general operation switch may be used by any person for controlling operation of the movable partition 102. The user-controlled switches 260 may be integrated with a display that presents a user with options to choose from in order to control operation of the movable partition 102, such as by selecting buttons, touch screen options, etc. In such an example, certain operations may be permitted only to authorized personnel and may be password protected.

The door display 272 may be included to present various status messages to the user about operation of the lead drive box 200, temperature or other environmental information on either side of the movable partition 102. Of course, it is contemplated that any other information may be displayed by the door display 272 that may be considered relevant or desired to users of the movable partition 102.

The vision panels 270 may include a cutout or window on each of the opposing sides 296 so that a person can see through the vision panels 270 to a region on the other side of the movable partition 102. For example, the vision panels 270 may be useful for verifying that it is safe to operate the movable partition 102 in consideration of what is seen of the region on the other side of the movable partition 102.

The remote control switch 274 may be associated with the movable partition 102, such as being coupled with and carried by the leading end of the movable partition 102. The remote control switch 274 may be coupled in parallel with the user-controlled switches 260 (FIGS. 2A and 2B), such that either the user-controlled switches 260 or the remote control switch 274 may be used to activate the motor 220 to move the movable partition 102. The remote control switch 274 may be activated by detection of a remote control key 276, as will be discussed further below with reference to FIG. 4.

The various sensors and switches of the user interface elements 250 may be coupled with one or more electronic component modules 292, 293, 294, which may be located within the lead drive box 200 at one or more of locations 282, 284, 286, 288. The electronic component modules 292, 293, 294 may further include a variety of electronic components such as, for example, sensors, switches, transistors, relays, resistors, capacitors, inductors, multiplexers, microprocessors, microcontrollers, and memory for carrying out functions of the motor 220 and lead drive box 200. As shown in FIG. 2C, some embodiments may include a plurality of electronic component modules 292, 293, 294 that are organized to perform different functions, but interact with each other to carry out all necessary functions of the motor 220 and lead drive box 200. In other embodiments, however, the electronic component modules 292, 293, 294 may be a single module that carries out the functions of the motor 220 and the lead drive box 200.

A motor control module 294 having electronic components for controlling operation of the motor 220 is located within the lead drive box 200. A post control module 292 having electronic components for controlling other operations of the lead drive box 200 is also located within the lead drive box 200. Operations controlled by the post control module 292 may include receiving input from various sensors, switches, buttons, or other sources of control signals and command signals. In some embodiments, these control signals, command signals and sensor signals may be multiplexed together with a multiplexer board 293 to save wiring between modules such as the post control module 292 and the motor control module 294.

The various electrical component modules (e.g., the motor control module 294, post control module 292, and multiplexer board 293) and the motor 220 may be configured to fit substantially within the partial enclosure of the lead drive box 200, as defined by the front side 295 and the opposing sides 296. In addition, the lead drive box 200 may include partial covers 291 that are configured for holding, covering, or a combination thereof one or more electrical component modules in the form of the motor control module 294, the post control module 292, the multiplexer board 293, and various combinations thereof.

As shown in FIG. 2C, the remote control switch 274 may be coupled to an inner surface of one of the opposing sides 296, such that the remote control switch 274 may not be visible on the outside of the movable partition 102. The remote control switch 274 may be coupled to the opposing side 296 through various methods of attachment, including adhesives, screws, bolts, and welding, as would be apparent to one skilled in the art. In some embodiments, the remote control switch 274 may be coupled to the front side 295 of the casing 299. Of course, it is contemplated that the remote control switch 274 may be coupled to the movable partition 102 at other locations, including locations that are not within the leading end of the movable partition 102; however, locating the remote control switch 274 proximate one or more of the electronic component modules 292, 293, 294 may simplify the wiring connections thereto.

FIG. 2C further illustrates a vertical arrangement of the motor 220, the motor control module 294 and the post control module 292 within the partial enclosure. This vertical arrangement can reduce space and enable the overall dimensions of the lead drive box 200 to be much smaller by efficiently utilizing the volume available in the vertical direction. In some embodiments, more space may be available allowing placement of the motor control module 294 side-by-side with the motor 220. Of course, many other configurations, combinations, and placements of the various control electronics (e.g., the motor control module 294, post control module 292, and multiplexer board 293) are contemplated within the partial enclosure region of the lead drive box 200.

In some embodiments, at least some of the electrical components may be disposed in one or both of the first wall 110A and the second wall 110B (FIG. 1). For example, some embodiments may include the motor 220, various switches, various sensors, and control electronics at either end of the track 114. However, in embodiments that include the motor 220, various switches, various sensors, and control electronics to be carried by the lead drive box 200, there may not be a need for routing wires carrying signals between the first and second walls 110A, 110B and to the lead drive box 200. As a result, an integrated arrangement of the motor 220 and other electronic modules within the lead drive box 200 creates many benefits.

Figure 3B:
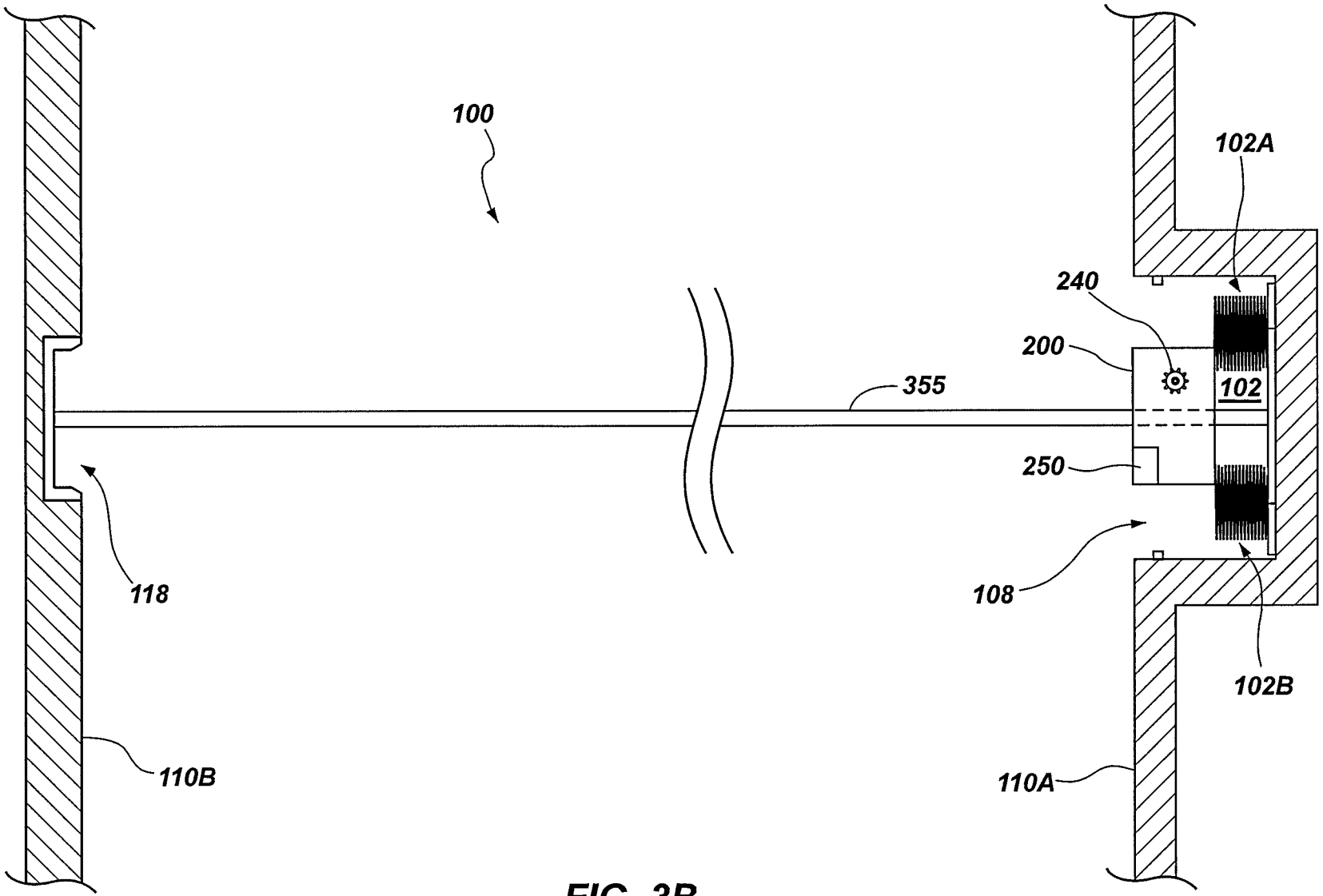

FIGS. 3A and 3B are a simplified top view of the movable partition system 100 of FIG. 1 including the lead drive box 200 of FIG. 2. As discussed briefly above, the movable partition 102 may extend between the first wall 110A and the second wall 110B of a room of a building (FIG. 1). The fixed drive member 355 may be fixed at both longitudinal ends of the track 114, such as in the pocket 108 in the first wall 110A and at the door jamb 118 (e.g., post) in the second wall 110B. The fixed drive member 355 may further be secured to the track 114 intermittently or continuously along its length for increased stability.

The fixed drive member 355 may be a fixed chain positioned adjacent the track 114 of the movable partition system 100. The rotatable drive member 240 may also be positioned adjacent the track 114 (e.g., within a drive channel of the track 114), and may be configured to interact with the fixed drive member 355. The rotatable drive member 240 may include a plurality of sprocket gears through which the fixed drive member 355 (e.g., chain), may be threaded. Of course, fewer or more gears and sprockets may be used.

In some embodiments, the fixed drive member 355 may comprise a rack and the rotatable drive member 240 may comprise a pinion, or the fixed drive member 355 may comprise a belt and the rotatable drive member 240 may comprise one or more pulleys. Any of these configurations and their equivalents may be used to drive the movable partition 102 along the track 114 in accordance with embodiments of the present disclosure.

As shown in FIG. 3A, when the movable partition 102 is in a fully extended state, the user interface elements 250 may be positioned within the mating surface of the opposing object (e.g., the door jamb 118). As shown in FIG. 3B, when the movable partition 102 is in a fully retracted state, the user interface elements 250 may be positioned within the pocket 108. As a result, the lead drive box 200 may substantially fill, and possibly be flush with, the front of the pocket 108 in the first wall 110A. In each of these such situations, access to the user interface elements 250 may be restricted, or in some cases completely blocked from an operator. Other configurations are contemplated in which the movable partition 102 may be in a position such that access to the user interface elements 250 is restricted.

Restricting access to the user interface elements 250 may position the user interface elements 250 in a protected position within the door jamb 118 (FIG. 3A) or the pocket 108 (FIG. 3B). As a result, such configurations may help protect the user interface elements 250 and related hardware from damage or destruction as well as from environmental elements while the movable partition 102 is stacked within the pocket 108 (FIG. 3B), or fully extended to mate with door jamb 118 (FIG. 3A). Such configurations may further ensure that the movable partition 102 may be at least partially "locked" to discourage unauthorized use of the movable partition 102 by making it more difficult for unauthorized personnel to access the user interface elements 250 (e.g., the general operation switch and remote control switch). Such a configuration may not limit the operation of an emergency alarm to automatically activate the movable partition 102, if desired. In addition, there may be the option to manually move the movable partition 102 fully across the room, or at least enough to expose the user interface elements 250.

Figure 4:
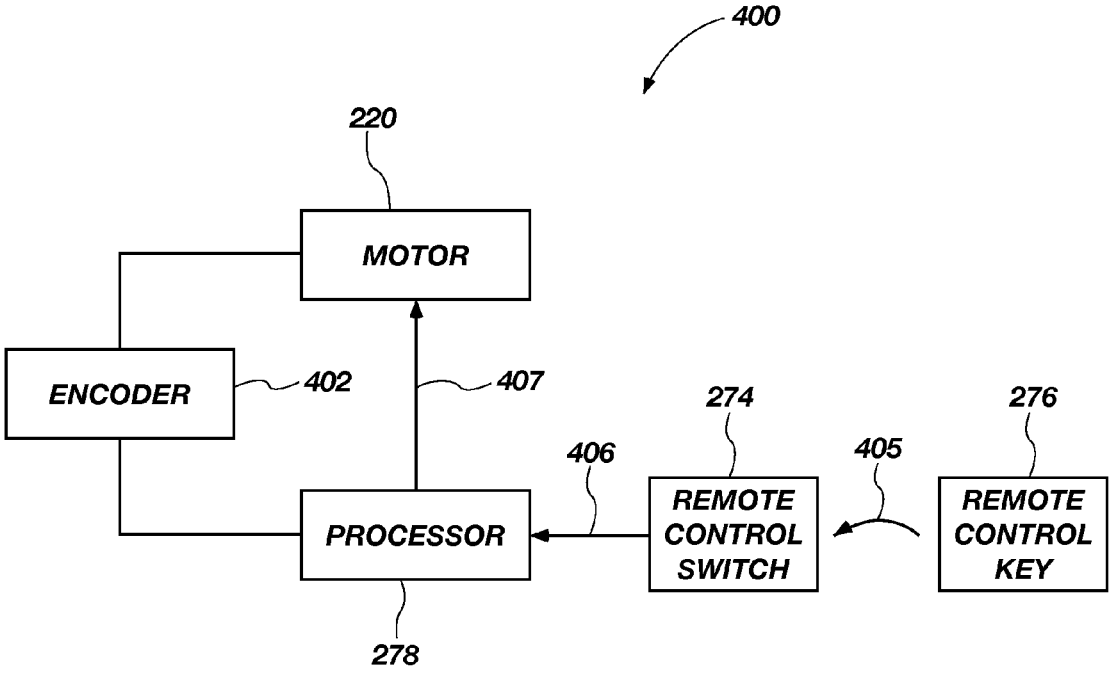
FIG. 4 is schematic block diagram of a remote control system according to an embodiment of the present disclosure.

FIG. 4 is schematic block diagram of a remote control system 400 according to an embodiment of the present disclosure. The remote control system 400 is configured to actuate the movable partition system 100. The remote control system 400 may be a parallel control system to that of the user interface elements 250 such that either the remote control system 400 or the user interface elements 250 may be used to control movement of the movable partition 102.

The remote control system 400 includes the remote control switch 274, a processor 278, and the remote control key 276, which were discussed briefly with respect to FIGS. 2A, 2B, and 2C. The processor 278 is coupled with the remote control switch 274 and the motor 220. The processor 278 may further be included and mounted within one of the electronic component modules 292, 293, 294 (FIG. 2C).

The remote control switch 274 may be configured to actuate the motor 220 responsive to detection of a signal from the remote control key 276. As discussed above, the remote control switch 274 may be coupled in parallel with the user-controlled switches 260 (FIGS. 2A, 2B), such that either the user-controlled switches 260 or the remote control switch 274 may be used to actuate the motor 220 that drives the movement the movable partition 102. Detection of the remote control key 276 may include reception of the remote activation signal 405 from the remote control key 276.

In some embodiments, the remote control switch 274 may be configured to be activated responsive to detection of a magnetic field generated by the remote control key 276. For example, the remote control switch 274 may include a reed switch, and the remote control key 276 may include a magnet. Thus, the remote control key 276 may be configured to produce a magnetic field as the remote activation signal 405. The magnetic field produced by the remote control key 276 may have a force sufficient to activate the remote control switch 274 through the casing 299 (FIGS. 2A, 2B, 2C) when the remote control key 276 is in the desired proximity of the movable partition 102 for activation thereof. Therefore, detection of the magnetic field generated by the remote control key 276 may indicate a physical proximity of the remote control key 276 to the movable partition 102. For example, an operator may approach the movable partition 102 and place the remote control key 276 in proximity of the remote control switch 274 such that the remote control switch 274 detects the magnetic field generated by the remote control key 276.

In some embodiments, the remote control key 276 may include a transmitter, and the remote control switch 274 may include a receiver. As a result, the remote control switch 274 and the remote control key 276 may be configured to communicate a wireless communication signal therebetween as the remote activation signal 405. For example, the communication signal may a transmitted signal activated by a user, such as being sent in response to the user pressing a button on the remote control key 276. As an example, the remote activation signal 405 may have a frequency that is recognized by the remote control switch 274, or include data containing instructions to the processor 278. As a further example, the remote control key 276 and the remote control switch 274 may communicate such data over a wireless communication link (e.g., BLUETOOTH®, etc.). For example, an operator may be proximate the movable partition 102 such that the remote activation signal 405 generated by the remote control key 276 may be detected by the remote control switch 274.

The user may press a button on the remote control key 276 that transmits the remote activation signal 405.

In response to receiving the remote activation signal 405, the remote control switch 274 may generate a trigger signal 406 to the processor 278 indicating that the remote control key 276 was detected. The processor 278 may responsively send an actuation signal 407 to the motor 220 to drive the motor 220 and move the movable partition 102 along the track 114. The processor 278 may control the motor 220 to move the movable partition 102 to a predetermined position. The processor 278 may know of the current position of the movable partition 102 through an encoder 402. The encoder 402 may determine the current position of the motor 220 through methods such as optical, magnetic, or other encoding methods. As an example, the encoder 402 may count the number of revolutions the motor 220 (or an element coupled with the motor 220) has made while moving the movable partition 102. The processor 278 may keep track of such counts, and convert the counts to a corresponding position of the movable partition 102 along the track 114. Thus, in operation, the encoder 402 may transmit information related to the current position of the movable partition 102 to the processor 278. As a result, the processor 278 may use such information to determine when to stop sending the actuation signal 407 to the motor 220 when the movable partition 102 has reached the desired position along the track 114.

In some embodiments, the processor 278 may be configured to partially retract or partially extend the movable partition 102 responsive to receiving the trigger signal 406 from the remote control switch 274. For example, the movable partition 102 may be initially in a fully closed state or a fully open state, such that the user interface elements 250 have restricted access (see FIGS. 3A and 3B). Thus, the movable partition 102 may be moved to a predetermined position, such as to a position that provides an operator with sufficient access to the user interface elements 250.

Examples of the movable partition 102 being moved to a desired predetermined position along the track 114 are shown in FIGS. 5A and 5B. For example, FIG. 5A shows the movable partition 102 being automatically moved to a desired position slightly away from the door jamb 118 sufficient to expose the user interface elements 250 to an operator. Thus, the movable partition 102 may have an initial first position shown in FIG. 3A, wherein the movable partition 102 is fully extended and the user interface elements 250 are within the door jamb 118 and not accessible. In response to detection of the remote control key 276, the motor 220 may be controlled to move the movable partition 102 to a second position shown in FIG. 5A. The second position shown in FIG. 5A may be a position that provides a user access to the user interface elements 250. Initiating this automatic movement of the movable partition 102 may permit an operator to have access to the user interface elements 250 without experiencing the difficulties of manual operation. From this second position, the operator may select the desired operations for controlling the movable partition 102 using the user interface elements 250.

FIG. 5B shows the movable partition 102 being automatically moved to a desired position slightly away from the pocket 108 sufficient to expose the user interface elements 250 to an operator. Thus, the movable partition 102 may have an initial first position shown in FIG. 3B, wherein the movable partition 102 is fully refracted and the user interface elements 250 are within the pocket 108 and not accessible. In response to detection of a signal from the remote control key 276 (e.g., physical proximity of a magnetic field, detection of a transmitted communication signal, etc.), the movable partition 102 may move to a second position shown in FIG. 5B. The second position shown in FIG. 5B may be a position that provides a user access to the user interface elements 250. Initiating this automatic movement of the movable partition 102 may permit an operator to have access to the user interface elements 250 without experiencing the difficulties of manual operation. From this second position, the operator may select the desired operations using the user interface elements 250.

In some embodiments, the remote control switch 274 may be coupled directly to the motor 220 without the processor 278. As a result, as long as the remote control switch 274 detects the remote control key 276, the remote control switch 274 may send the trigger signal 406 directly to the motor 220 to move the movable partition 102. In other words, the trigger signal 406 may be the actuation signal 407 to the motor 220. In such an embodiment, the operator may choose to maintain actuation signal 407 from the remote control key 276 to activate the remote control switch 274 to position the movable partition 102 to an intermediate position along the track 114. As a result, the operator may use the remote control key 276 to activate the remote control switch 274 to move the movable partition 102 to an intermediate position partially along the track 114 as desired by the operator.

FIG. 6 shows the remote control key 276 of FIGS. 2A, 2B, and 2C, according to an embodiment of the present disclosure. As discussed above, the remote control key 276 may be configured to actuate the remote control switch 274 without direct physical contact with the remote control switch 274. In one embodiment, the remote control key 276 is configured to produce a magnetic field as the remote activation signal 405 that is detected by the remote control switch 274.

In such an embodiment, the remote control key 276 may include a base portion 602 coupled with a magnetic portion 604. The magnetic portion 604 may be embedded, molded into, adhered to, or otherwise attached to the base portion 602. The remote control key 276 may include a cap portion 606 that is configured to fit over the magnetic portion 604 and removably couple (e.g., snap) to the base portion 602. The cap portion 606 may be configured to protect the magnetic portion 604, and limit the magnetic field produced by the magnetic portion 604 such that the remote control key 276 is unlikely to inadvertently trigger the remote control switch 274 when the operator is near the movable partition 102 with the remote control key 276, but does not wish to actuate the motor 220. The remote control key 276 may further include an aperture 608 that may be used to attach to a key chain or other object for the convenience of the operator.

FIG. 7 is a flowchart 700 for a method of remotely controlling movement of a movable partition 102 according to an embodiment of the present disclosure. At operation 710, the remote control key 276 is detected. The remote control key 276 may be detected by receiving the remote activation signal 405 generated by the remote control key 276. The remote control key 276 may produce a magnetic field, a wireless communication signal, or another signal as the remote activation signal 405.

At operation 720, the current position of the movable partition 102 along the track 114 may be determined. The current position may be determined by the encoder 402. For example, the encoder 402 may be configured to count the number of rotations of the motor 220 and convert the number of counts to correspond to a measurement or position of the movable partition 102 along the track 114. At operation 730, the desired position for the movable partition 102 may be determined. The desired position may be a predetermined position that may be dependent upon the present position of the movable partition 102. An example of such a determination is discussed below with respect to FIG. 8. At operation 740, the movable partition 102 may be moved to the predetermined position.

FIG. 8 is a representation of the various positions of the track 114 of the movable partition system 100. The various positions of the track 114 may correspond to positions at which the movable partition 102 may be currently positioned, or to which the movable partition 102 may be moved according to an embodiment of the present disclosure. The various positions are individually referred to as a first position $P_1$, a second position $P_2$, a third position $P_3$, a fourth position $P_4$, a fifth position $P_5$, a sixth position $P_6$, and a seventh position $P_7$. If the movable partition 102 is fully extended, the movable partition 102 is at the first position $P_1$. If the movable partition 102 is fully retracted, the movable partition 102 is at the seventh position $P_7$. As discussed above with respect to FIGS. 3A and 3B when the movable partition 102 is fully retracted or fully extended, the user interface elements 250 of the movable partition 102 may be restricted from being accessed by an operator.

In addition, the second position $P_2$ may be defined in this example as the position that is near the first position $P_1$ such that the second position $P_2$ is just slightly retracted to permit access to the user interface elements 250. Similarly, the sixth position $P_6$ may be defined as the position that is near the seventh position $P_7$ such that the sixth position $P_6$ is just slightly extended to permit access to the user interface elements 250. The third position $P_3$ and the fifth position $P_5$ are arbitrarily selected positions along the track 114. The third position $P_3$ is relatively closer to the first position $P_1$ than the seventh position $P_7$, while the fifth position $P_5$ is relatively closer to the seventh position $P_7$ than the first position $P_1$. The fourth position $P_4$ is the midpoint of the track 114. The movable partition 102 may be at one of the third position $P_3$, the fourth position $P_4$, or the fifth position $P_5$ as selected by the operator through the user interface elements 250 or through some manual movement of the movable partition 102. The movable partition system 100 may know of the position of the movable partition 102 along the track 114 through the use of the encoder 402. Of course, the various positions shown herein are shown as examples, and any number of positions may be known by the movable partition system 100 according to the resolution of the encoder 402. Such positions $P_1$ through $P_7$ may be stored in a computer readable medium (e.g., memory) such that the processor 278 may determine the desired position along the track 114 and cause the motor 220 to drive the movable partition 102 to the desired position using the data from the encoder 402 as feedback.

In the previously discussed embodiments, the remote control system 400 is described as moving the movable partition 102 from either a fully extended position or a fully retracted position to a predetermined position that provides access to the user interface elements 250. For example, the movable partition 102 may be moved from the first position $P_1$ to the second position $P_2$ in response to the remote activation signal 405 in order to provide sufficient access to the user interface elements 250. Similarly, the movable partition 102 may be moved from the seventh position $P_7$ to the sixth position $P_6$ in response to the remote activation signal 405 in order to provide sufficient access to the user interface elements 250.

The remote control system 400 may perform additional operations as to the control of the movement of the movable partition 102. For example, if the remote activation signal 405 is received while the movable partition 102 is at the second position $P_2$, the remote control system 400 may be configured to move the movable partition 102 back into the first position $P_1$ in order to fully extend the movable partition 102 and again restrict access to the user interface elements 250. Similarly, if the remote activation signal 405 is received while the movable partition 102 is at the sixth position $P_6$, the remote control system 400 may be configured to move the movable partition 102 back into the seventh position $P_7$ in order to fully extend the movable partition 102 and again restrict access to the user interface elements 250.

In some embodiments, if the movable partition 102 is at another position along the track 114, the remote control system 400 may be configured to further extend or retract the movable partition 102 to the predetermined position that is closest to the present position of the movable partition 102. For example, if the remote activation signal 405 is received while the movable partition 102 is at the third position $P_3$, the remote control system 400 may be configured to move the movable partition 102 to the second position $P_2$, the first position $P_1$, or another predetermined position as desired. Similarly, if the remote activation signal 405 is received while the movable partition 102 is at the fifth position $P_5$, the remote control system 400 may be configured to move the movable partition 102 to the sixth position $P_6$, the seventh position $P_7$, or another predetermined position as desired. As the fourth position $P_4$ is the midpoint of the track 114, the remote control system 400 may move the movable partition 102 to whichever position the designer determines to be most desirable.

In some embodiments, it may be desirable for the remote control system 400 to be disabled while the movable partition 102 is at a position along the length of track 114. For example, it may be desirable to limit operation of the remote control system 400 to operate only when the user interface elements 250 of the movable partition 102 are not accessible (e.g., at positions $P_1$ and $P_7$). Thus, even if the remote control system 400 detects the remote activation signal 405 from the remote control key 276, the processor 278 may not generate the actuation signal 407 to the motor 220. In some embodiments, the remote control system 400 may disable the remote control switch 274 from detecting the remote activation signal 405 at positions of the movable partition 102 where it would be desirable to do so (e.g., where the user interface elements 250 are accessible by an operator).

FIG. 9 is a flowchart 900 for a method of remotely controlling movement of a movable partition 102 according to an embodiment of the present disclosure. At operation 910, the remote activation signal 405 may be received. The remote activation signal 405 may be generated by the remote control key 276 and detected by the remote control switch 274. For example, the remote control key 276 may include a magnet that produces a magnetic field that is detected by the remote control switch 274 (e.g., a reed switch). In some embodiments, the remote control key 276 may generate a wireless communication signal having a certain frequency recognized by the remote control switch 274, or containing data providing instructions for the remote control switch 274.

In response to receiving the remote activation signal 405, the movable partition 102 may be moved to a predetermined position along the track 114 of the movable partition system 100. For example, the predetermined position may be at a location that is just far enough to provide access to the user interface elements 250 that may otherwise be blocked if the movable partition 102 is extended (e.g., the user interface elements 250 are within the door jamb 118) or retracted (e.g., the user interface elements 250 are within the pocket 108).

As an example, at operation 920 it may be determined if the movable partition 102 is extended or retracted. If the movable partition 102 is retracted, the motor 220 may be actuated to at least partially extend the movable partition 102 along the track 114 at operation 930. If the movable partition 102 is extended, the motor 220 may be actuated to at least partially retract the movable partition 102 along the track 114 at operation 940. For example, the motor 220 may be configured to position the movable partition 102 to a predetermined position along the track 114 so as to provide access to the user interface elements 250 coupled with the leading end of the movable partition 102. At this position, an operator may have access to the user interface elements 250 to further control the operation of the movable partition 102. Other operations may be performed in response to the remote activation signal 405 that depends on the current position of the movable partition 102 as previously discussed. In addition, some embodiments may include disabling actuation of the motor 220 from being controlled through the remote control system 400 when the movable partition 102 is at certain positions (e.g., positions where the user interface elements 250 are not accessible).

With the user interface elements 250 accessible to the operator, the operator may control movement of the movable partition 102 through the user interface elements 250. At operation 950, the instructions from the user interface elements 250 may be received. At operation 960, the selected operation may be performed. Selected operations may include fully retracting or fully extending the movable partition 102, partially retracting or partially extending the movable partition 102 to another predetermined position along the track 114, among other operations.

CONCLUSION

Embodiments of the present disclosure include a remote control system for use with a movable partition. The remote control system comprises a motor configured to drive movement of a movable partition of a movable partition system, a processor coupled with the motor to generate an actuation signal to control the motor, and a remote control switch coupled with the motor and configured to transmit a trigger signal to the processor in response to receiving an activation signal from a remote control key. The processor is configured to control the motor to drive the movable partition to a predetermined position along a track in response to the trigger signal.

Another embodiment of the present disclosure includes a movable partition system. The movable partition system comprises a movable partition coupled to a track extending between a first wall and a second wall, a motor configured to drive movement of the movable partition, and a remote control system operably coupled with the motor. The remote control system is configured to send an actuation signal to the motor in response to detection of an activation signal from a remote control key, and control the motor to drive the movable partition to an intermediate position along the track.

Another embodiment of the present disclosure includes a method of driving a movable partition. The method comprises receiving a wireless activation signal from a remote control key, and driving the movable partition to an intermediate position along a track to provide access to user interface elements of the movable partition in response to receiving the wireless activation signal.

Another embodiment of the present disclosure includes a method of installing a movable partition system. The method comprises suspending a movable partition comprising at least one sheet of interconnected panels connected to a lead post at an end of the movable partition from a track extending between a first wall and a second wall, coupling a motor with the movable partition to drive movement of the movable partition, and coupling a remote control system with the motor. The remote control system is configured to send an actuation signal to the motor in response to detection of an activation signal from a remote control key, wherein the remote control system is configured to control the motor to drive the movable partition to an intermediate position along the track.

While the present disclosure is susceptible to various modifications and alternative forms, specific embodiments have been shown by way of example in the drawings and have been described in detail herein. However, the invention is not intended to be limited to the particular forms disclosed. Rather, the invention covers all modifications, combinations, equivalents, and alternatives falling within the scope of the following appended claims and their legal equivalents.

What is claimed is:

1. A remote control system for use with a movable partition, comprising:

a motor configured to drive movement of a movable partition of a movable partition system;

a processor coupled with the motor to generate an actuation signal to control the motor;

user interface elements operably coupled with the processor and disposed externally on the movable partition such that an operator does not have access to the user interface elements when the movable partition is in a fully extended position or a fully retracted position; and a remote control switch coupled with the motor and configured to transmit a trigger signal to the processor in response to receiving an activation signal from a remote control key, wherein the processor is configured to control the motor to drive the movable partition to a predetermined intermediate position along a track to provide the operator with access to the user interface elements in response to the trigger signal.

2. The remote control system of claim 1, wherein the activation signal is a magnetic field produced by the remote control key, and the remote control switch includes a reed switch.

3. The remote control system of claim 1, wherein the remote control key includes a transmitter, and the remote control switch includes a receiver configured for communication of the activation signal therebetween.

4. The remote control system of claim 1, wherein the processor is configured to control the motor to drive the movable partition to another predetermined position along the track in response to detection of the trigger signal when the movable partition is in the predetermined intermediate position, wherein the another predetermined position is another location to return the user interface elements of the movable partition to a restricted access position.

5. A movable partition system, comprising:

a movable partition coupled to a track extending between a first wall and a second wall;

a motor configured to drive movement of the movable partition;

user interface elements that are configured to enable an operator to control operation of the movable partition, wherein the user interface elements are positioned externally on the movable partition such that the operator does not have access to the user interface elements when the movable partition is in at least one of a substantially fully extended position and a substantially fully retracted position; and a remote control system operably coupled with the motor, and configured to send an actuation signal to the motor in response to detection of an activation signal from a remote control key, wherein the remote control system is configured to control the motor to drive the movable partition to a predetermined intermediate position along the track such that the user interface elements are accessible by the operator.

6. The movable partition system of claim 5, wherein the remote control system includes a remote control switch coupled in parallel with another user-controlled switch such that either the remote control switch or the user-controlled switch controls the motor.

7. The movable partition system of claim 5, wherein the movable partition is configured to collapse at least partially within a pocket formed in the first wall when the movable partition is in the substantially fully retracted position.

8. The movable partition system of claim 5, wherein the remote control system includes an encoder and a processor that monitor a position of the movable partition along the track, and wherein the predetermined intermediate position is a predetermined position stored in memory and accessible by the processor.

9. The movable partition system of claim 5, wherein the user interface elements and the motor are carried by a partial enclosure of a lead drive box coupled to a leading end of the movable partition system.

10. The movable partition system of claim 9, wherein the remote control switch is coupled to an internal wall of the lead drive box, wherein the remote control switch is configured to detect the activation signal.

11. The movable partition system of claim 10, wherein the activation signal from the remote control key is a magnetic field produced by the remote control key.

12. The movable partition system of claim 10, wherein the activation signal from the remote control key is communicated over a wireless communication signal to the remote control switch.

13. A method of driving a movable partition, the method comprising:

receiving a wireless activation signal from a remote control key; and driving a movable partition from one of a fully extended position or a fully retracted position along a track, wherein in at least one of the fully extended position or the fully retracted position an operator does not have access to user interface elements positioned externally on the movable partition, to a predetermined intermediate position along the track to provide the operator with access to the user interface elements on the movable partition in response to receiving the wireless activation signal.

14. The method of claim 13, wherein receiving the wireless activation signal from the remote control key includes detecting a magnetic field as the wireless activation signal.

15. The method of claim 13, further comprising driving the movable partition from the predetermined intermediate position to another position along the track in response to the operator selecting an operation through the user interface elements.

16. The method of claim 15, wherein driving the movable partition from the predetermined intermediate position to another position along the track includes at least one of fully extending and fully retracting the movable partition along the track.

17. A method of installing a movable partition system, the method comprising:

suspending a movable partition comprising at least one sheet of interconnected panels connected to a lead post at an end of the movable partition from a track extending between a first wall and a second wall;

coupling a motor with the movable partition to drive movement of the movable partition;

coupling user interface elements externally on the movable partition; and coupling a remote control system with the motor, the remote control system configured to send an actuation signal to the motor in response to detection of an activation signal from a remote control key, wherein the remote control system is configured to control the motor to drive the movable partition from one of a fully extended position or a fully retracted position, wherein in at least one of the fully extended position or the fully retracted position, an operator does not have access to the user interface elements of the movable partition, to a predetermined intermediate position along the track to provide the operator with access to the user interface elements.

* * * * *